United States Patent [19]

Zaccaria

[11] 4,094,255

[45] June 13, 1978

[54] ARTIST'S PALETTE, PAINT AND ACCESSORY STAND

[76] Inventor: Nathan J. Zaccaria, 257 Glen Ave., Palisades Park, N.J. 07650

[21] Appl. No.: 766,232

[22] Filed: Feb. 7, 1977

[51] Int. Cl.[2] ..... A47B 85/00

[52] U.S. Cl. ..... 108/25; 108/150; 248/161

[58] Field of Search ..... 108/25, 26, 28, 150; 248/158, 159, 161, 441 R, 450

[56] References Cited

U.S. PATENT DOCUMENTS

| | | | |
|---|---|---|---|
| 522,221 | 7/1894 | Lucashevski | 108/150 |
| 1,434,000 | 10/1922 | Gibbs | 248/158 |
| 2,285,576 | 6/1942 | Fox | 108/25 X |
| 2,490,649 | 12/1949 | Polis | 108/25 X |
| 2,861,386 | 11/1958 | Paulsen et al. | 108/28 X |
| 3,756,166 | 9/1973 | Piretti | 108/25 X |
| 3,934,806 | 1/1976 | Bady | 248/441 R |

*Primary Examiner*—James C. Mitchell
*Attorney, Agent, or Firm*—Richard L. Miller

[57] ABSTRACT

A stand for use by an artist to hold all his necessary painting equipment including palette, paints, brushes and the like; the stand including a pedestal having sideward spreading feet at its lower end, and the upper end of the pedestal having mounted thereupon, a horizontal flat board and a box-like tray adjacent one edge thereof.

9 Claims, 13 Drawing Figures

17
18
22
16
24
23
21
22
10
11
12
12c
12a
13
12b
12c 21
19
11
21
3
3

17
19
21
21
25
11
4
4

24
23
20
25
13
14
14
12a
12b
15
15

11
50
51
52

62
65
66
60
64
66
61
63

71
79A
72
79
70
73
74
74
76
75
76
74

77

78
78
79A
79
71
73
72
9
9
77
71
79A
79

100
101
102
104
105
103

110
110
110

120
120

130
130

ARTIST'S PALETTE, PAINT AND ACCESSORY STAND

This invention relates generally to artist's equipment. More specifically it relates to a stand upon which objects can be supported.

A principal object of the present invention is to provide a stand upon which an artist can place all his needed equipment while painting a picture, and which will hold his palette, paints, palette knife, brushes, liquid vehicles such as oil, terpentine or water, wiping rags and the like.

Another object is to provide an artist's stand which holds all the equipment at a convenient level so to be easily reached as needed.

Yet another object is to provide an artist's stand which accordingly by keeping all the equipment on a single stand, prevents clutter of a room by spreading the equipment upon other furniture such as table and chairs, so that a room may be maintained neat and in order during the painting work, and which when not in use can be placed unobtrusively into a corner or out of a way.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figures 1, 2, 3, 4, 5, 6:
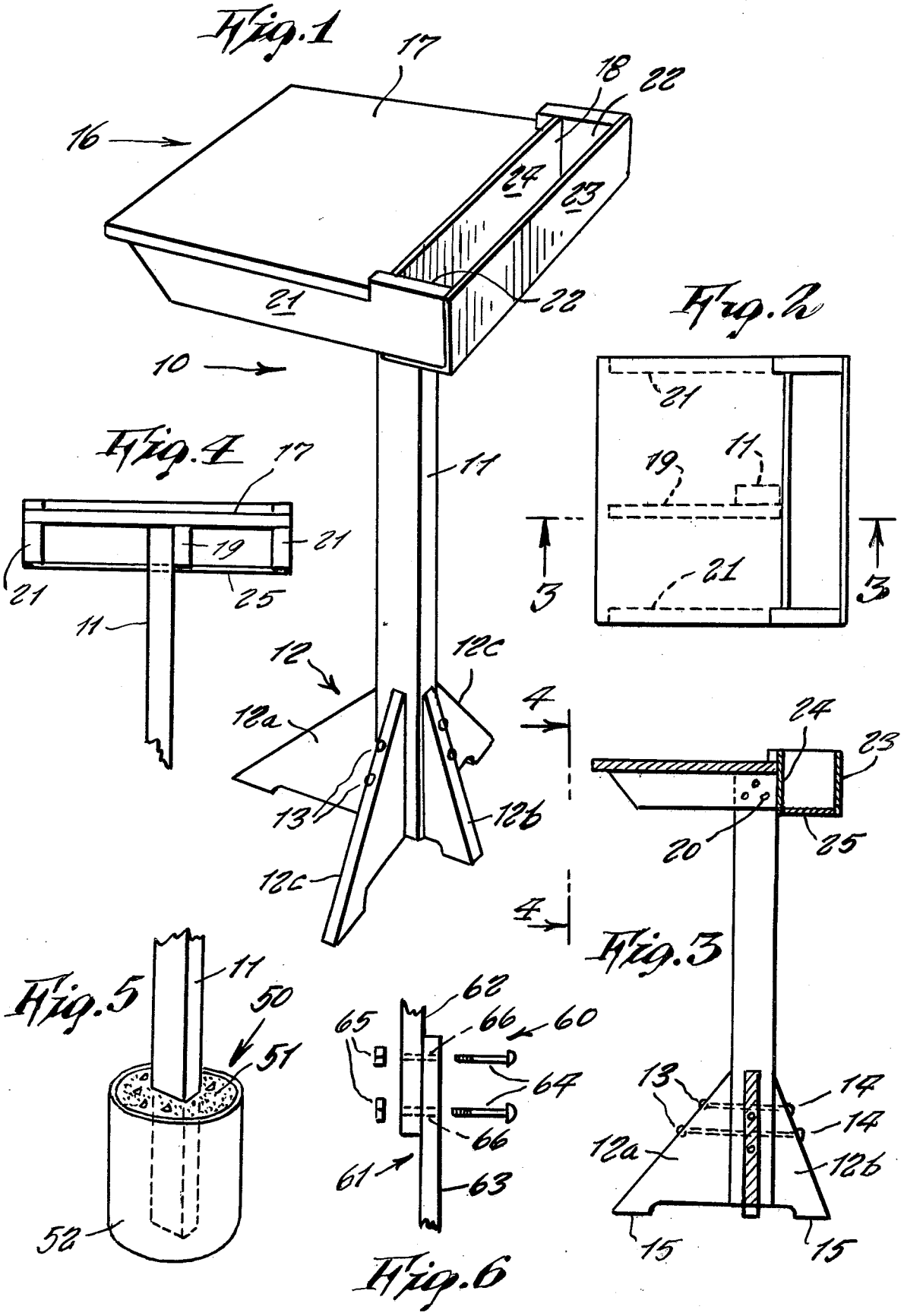
FIG. 1 is a perspective view of a wood constructed model of the invention.
FIG. 2 shows a top view thereof.
FIG. 3 is a cross-section on line 3—3 of FIG. 2.
FIG. 4 is a view in direction 4—4 of FIG. 3.
FIG. 5 shows a modified base of concrete.

FIG. 6 a detail of a two piece post for being bolted together.

Figures 7, 8, 9, 10, 11, 12, 13:
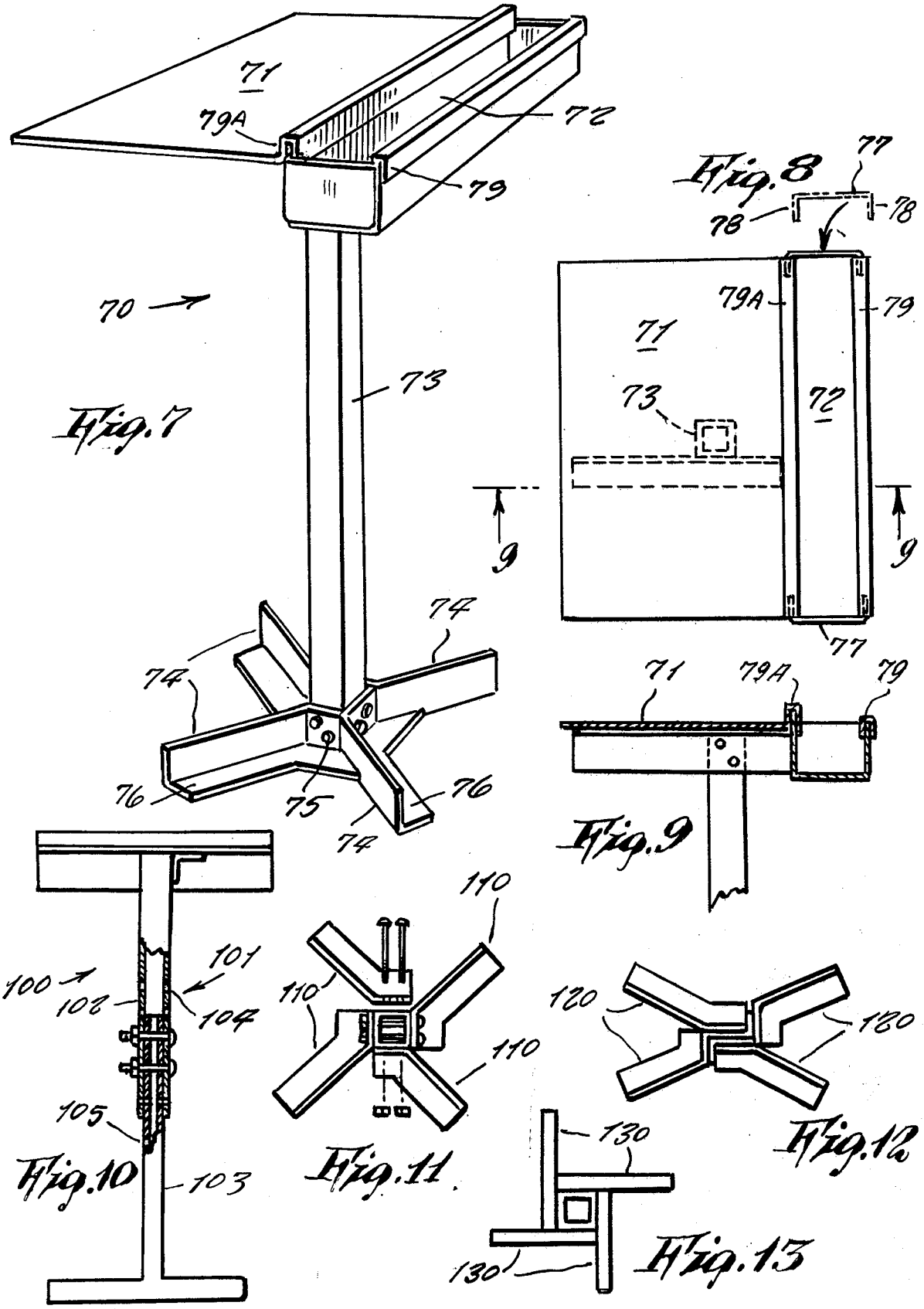

FIG. 7 is a perspective view of a metal constructed model of the invention.

FIG. 8 is a top view thereof.

FIG. 9 is a cross-section on line 9—9 of FIG. 8.

FIG. 10 is a front view of a telescopic posted model, shown partly in cross-section.

FIGS. 11, 12, and 13 are top views of different designs of bases for the metal model.

Referring now to the drawing in detail, and more particularly to FIGS. 1 through 4 thereof at this time, the reference numeral 10 represents an artist's palette, paint and accessory stand according to the present invention wherein there is a vertical, upright pedestal 11 made of a wooden beam such as a "2×4", and which at its lower end is attached to four feet 12, extending on all four sides thereof. Each foot comprises a flat wooded panel made possibly of one inch thick lumber so to be strong, and which is cut into a generally triangular shape and fastened to the upright beam by bolts 13 passed through the beam and opposite side feet as shown in FIG. 3. A nut 14 is on the end of each bolt. Each foot at its outward end has a downward toe 15. As shown in FIG. 3, one of the feet 12*a* is substantially horizontally longer than a foot 12*b* on an opposite side thereof, which the other two feet 12*c* are each of an intermediate horizontal length for reasons as will be evident later.

Upon the top of the pedestal, there is mounted a platform unit 16 which includes a horizontal flat table top 17 and a box-like tray 18. The table top is made from a wooden panel and is nailed upon three wooden cross-beams, a center one 19 of which is fastened by nails 20 or the like to the upper end of the pedestal which the side edge cross-beams 21 each project beyond an end of the table top so to form opposite sides 22 of the tray. A wooden end panel 23 secured to the end of the cross beams forms a long sidewall of the tray, while another panel 24 an opposite side thereof, and a horizontal panel 25 forms a bottom of the tray.

The platform unit 16 is at an elevation so to be convenient for an artist to reach items placed thereupon.

The longer extending foot 12*a* is located under the table top which also projects a longer sidward distance from the pedestal, the foot 12*a* thus preventing the stand to tip over if a heavy object is placed on the outward end of the table top.

In FIG. 5, a modified design 50 of the invention shows the lower end of the pedestal post set into a concrete 51 placed into a container 52.

In FIG. 6, another modified design 60 shows a pedestal post 61 comprised of two beams 62 and 63 fastened together by bolts 64 and nuts 65, so that the pedestal may be readily collapsible for less space storage and which allows the platform unit to be at a lower elevation if the bolt openings 66 are made a uniform distance apart as corresponding bolt openings in an upper post 62 of the unit 16.

In FIGS. 7, 8, and 9, another modified design of stand 70 is made of metal instead of wood and includes all the features as stand 10, including a table top 71 and tray 72. The pedestal post 73 is hollow extruded metal and the feet 74 are each of angle irons secured to the post by bolts 75. In this design a flange 76 of each foot rests flat on a floor. End walls 77 have tabs 78 to snap in slots of channel 79 and a channel 79A of the table top.

In FIG. 10 the stand 100 has a pedestal post 101 comprised of sections 102 and 103 that are telescopically adjustable into various different heights by means of a row of openings 104 of one section being selectively aligned with any of a row of openings 105 in the other section.

FIG. 11 shows a same construction of feet 110 as is shown in FIG. 7 except that they are bent into opposite directions.

In FIG. 12 still other shape of feet 120 are shown that extend in pairs into principally two opposite directions.

In FIG. 13 the feet 130 are each straight, the feet extending equally in all directions parallel to side faces of the pedestal post instead angularly as the other foregoing feet.

While certain novel features of this invention have been shown and described and are pointed out in the annexed claims, it will be understood that various omissions, substitutions, and changes in the forms and details of the device illustrated and in its operation can be made by those skilled in the art without departing from the spirit of the invention.

What is claimed is:

1. An artist's palette, paint and accessory stand, comprising in combination an upright pedestal post, feet means secured around a lower end of said post, and a platform unit including a horizontal table top, a box-like tray adjacent one side edge of said table top, and a cross-beam attached to the underneath side of the table top and extending from said tray to proximate the opposing side-edge of the table top, said cross-beam being attached to an upper end of said post.

2. The combination as set forth in claim 1 wherein said stand is of wood, said post attachment to said cross-beam is closer to said one side edge than to said opposing side edge, and wherein said feet means are triangular panels of varied sizes, one panel extending toward said opposing side being the longest, one panel extending toward said side-edge being the shortest, and two panels extending perpendicuarly to said first two panels and being intermediate in length.

3. The combination as set forth in claim 1 wherein said stand is of wood and said feet means comprises concrete in a container.

4. The combination as set forth in claim 1 wherein said stand is of metal and said feet means comprise metal angle irons having an L-shaped cross-section.

5. The combination as set forth in claim 1 wherein said post is comprised of sections connected together for adjustable heights of said platform unit.

6. The combination as set forth in claim 4 wherein said post is of rectangular shape, and wherein there are four metal angle irons, each angle iron having a first leg abutting a respective one side of said post and a second leg angularly extending in the same plane from said first leg, and coupling means simultaneously interconnecting two opposing angle irons respectively to said post.

7. The combination as set forth in claim 1 and further comprising a vertical wall transversely abutting said one side edge of said table top and extending upwardly therefrom to form a stop wall, said vertical wall simultaneously serving as one end wall of said tray.

8. The combination as set forth in claim 1 and wherein said box-like tray has a front, rear, and bottom wall, and wherein said one side edge of said table top terminates in an inverted U-shaped channel which couples onto said front wall.

9. The combination as set forth in claim 8 and wherein said rear wall terminates in an inverted U-shaped channel, and further comprising end walls having protruding tabs which snap into said two inverted U-shaped channels.

* * * * *